United States Patent [19]

Marulli

[11] 3,936,985

[45] Feb. 10, 1976

[54] PANEL FOR ELECTROPLATING BARREL SIDEWALL

[75] Inventor: Alfred N. Marulli, Bristol, Conn.

[73] Assignee: National Plastics & Plating Supply Co., Inc., Terryville, Conn.

[22] Filed: Feb. 20, 1975

[21] Appl. No.: 551,099

[52] U.S. Cl. ..... 52/98; 52/660; 204/213; 259/89

[51] Int. Cl.[2] ..... E04C 2/42

[58] Field of Search ..... 204/213, 214; 259/89, 90; 210/498; 52/98, 100, 660, 661, 663

[56] References Cited

UNITED STATES PATENTS

| | | | |
|---|---|---|---|
| 1,940,952 | 12/1933 | Hutchens | 210/498 |
| 2,419,155 | 4/1947 | Orton | 210/498 |
| 3,394,071 | 7/1968 | Gill | 204/213 |
| 3,472,753 | 10/1969 | Wojtanek | 204/213 |
| 3,498,902 | 3/1970 | Wojtanek | 204/213 |
| 3,582,523 | 6/1971 | Linnhoff | 259/89 |
| 3,716,470 | 3/1973 | Noonan | 204/213 |
| 3,802,144 | 4/1974 | Spica | 52/100 |

FOREIGN PATENTS OR APPLICATIONS

| | | | |
|---|---|---|---|
| 143,894 | 1/1902 | Germany | 210/498 |
| 15,598 | 12/1885 | United Kingdom | 210/498 |

*Primary Examiner*—Frank L. Abbott
*Assistant Examiner*—Henry Raduazo
*Attorney, Agent, or Firm*—McCormick, Paulding & Huber

[57] ABSTRACT

Polygon shaped barrels of different size can be readily assembled from conventional end plates of appropriate diameter, and conventional support members connect the end plates to one another to define rectangular openings. Panels, which can be readily cut to size along predetermined lines are placed in these openings. The largest barrel size utilizes panels which need not be cut, whereas proportionately smaller barrels are made up from panels cut to predetermined, somewhat smaller, sizes. Each panel includes an outer portion having relatively wide generally longitudinally extending ribs, and intersecting cross ribs, to define relatively large rectangular openings. The inner portion of each panel has smaller openings defined by partitions molded integrally to this one-piece, "one-size" panel.

9 Claims, 6 Drawing Figures

PANEL FOR ELECTROPLATING BARREL SIDEWALL

SUMMARY OF INVENTION

This invention relates generally to electroplating barrels, and deals more particularly with a unique panel construction for assembling polygon shaped barrels of different size.

The general object of the present invention is to provide a panel construction which can be molded in one-size, and in one-piece, with the configuration of the panel being such that it can be used either directly as so molded for assembling large size polygon shape barrels, or can be used after first being cut along a predetermined line to provide a slightly smaller size polygon shape barrel.

The foregoing aim is achieved by providing a one-piece panel with integrally molded inner and outer grid portions provided within a rectangular frame, the panel having at least one longitudinally extending brace defined just inside a line of weakening or score line in the panel, which construction not only permits the panel to be cut but also provides a slightly smaller frame for this rectangular panel to allow assembly of slightly smaller size electroplating barrel.

The use of generally flat rectangular panels to assemble a polygon shaped electroplating barrel is well known in the art. Further, the provision of a generally rectangular frame, defining a plurality of rectangular openings, which frame is covered by a mesh with predetermined opening sizes, is also known in the art. However, such a panel can be used only to assemble a barrel of one particular size. The present invention seeks to provide a one design panel which can be severed along predetermined lines to define more than one rectangular panel size for use in assembling electroplating barrels of a variety of diameters and axial lengths. In order to preserve the generally rectangular frame associated with the smaller size panel braces are integrally molded in the panel, and it is a further feature of the present invention that the generally reatangular openings defined in the grid work of the panel are also provided with partitions, which partitions define the relatively small openings through which the electrolytic fluid is adapted to be passed, and which openings are preferably of such a size that the articles being electroplated do not become snagged in or pass through the openings of the panel.

The one-piece panel can be integrally molded in an injection molding machine or can be compression molded or formed in a process combining these techniques, or by transfer molding process. The panel is provided with breaker bars defined on the inside surface of the panel such that the articles being plated are caused to be continuously tumbled as the barrel is rotated. All of these features are provided in a one-piece panel molded from a chemically inert plastic material such as polypropylene which material is also provided with a predetermined quantity of chopped glass fibers to improve its wear resistance, and to provide a panel better able to resist distortion due to extremes of heat or the like.

DETAILED DESCRIPTION

Figure 1:
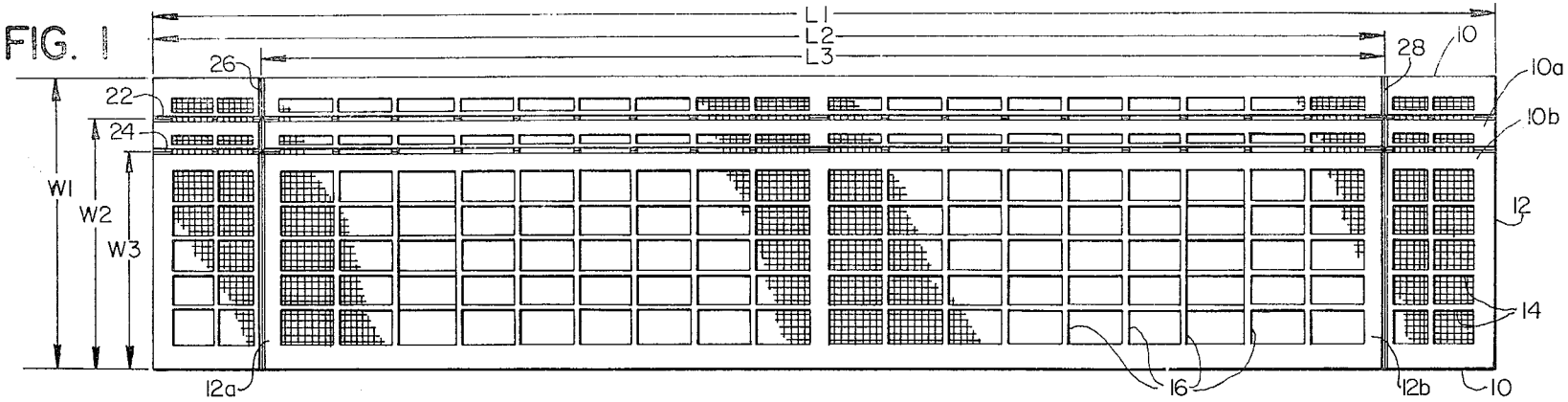
FIG. 1 is a plan view showing the outside surface of a one-piece, one-size panel constructed in accordance with the present invention and adapted for use in assembling a generally polygon shaped barrel sidewall, the panel being so designed as to provide use in a predetermined number of lengths, and also a predetermined number of widths.
Figure 2:
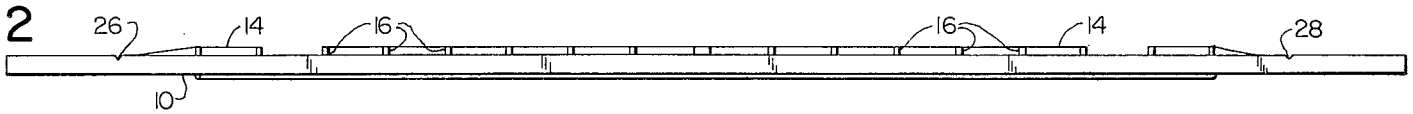
FIG. 2 is a side elevational view of the panel illustrated in FIG. 1.
Figure 3:
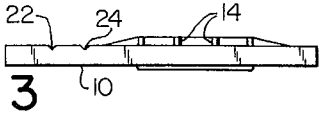
FIG. 3 is an end view also in elevation illustrating the panel of FIGS. 1 and 2.

Turning now to the drawings in greater detail, FIG. 1 shows a rectangular panel having a long side L1 and a short side W1 which cooperate with one another to define a generally rectangularly shaped frame. This frame is integrally molded from a chemically inert plastic material such as polypropylene preferably with a significant quantity (10–30%) of chopped glass fibers added thereto in order to improve the wear resistance of the panel when assembled in an electroplating barrel of polygon shape and to reduce distortion of the panel due to high temperature environment. The marginally extending sides 10 and 12 of the rectangular panel frame have a generally square cross sectional configuration as best shown in FIGS. 4 and 5.

The rectangular frame comprises one portion of the integrally molded panel, another portion comprising the outer, or upper grid portion defined within the frame and integrally molded thereto. This outer portion includes longitudinally extending ribs 14, 14 arranged parallel to the long side 10 of the rectangular frame, and cross ribs which intersect these longitudinally extending ribs to define relatively large rectangular openings therebetween as best shown, for example, in FIG. 1. The cross ribs are indicated generally by the reference numeral 16, and FIGS. 4 and 5 show the relative sizes of these ribs to better advantage.

Figure 4:
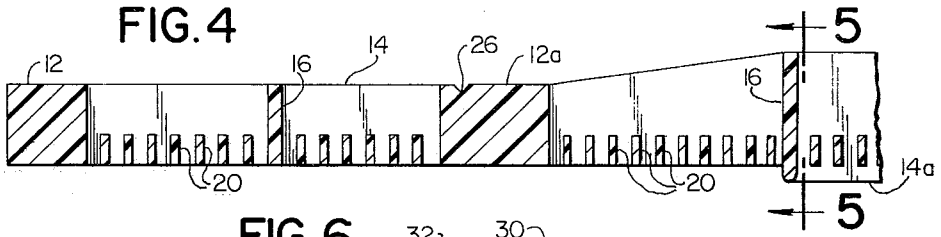
FIG. 4 is an enlarged view taken in vertical cross section of one end portion of the panel depicted in FIG. 1
Figure 5:
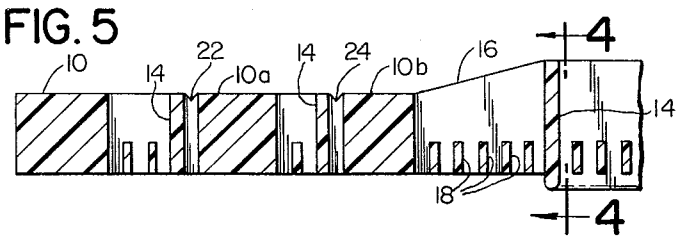
FIG. 5 is a vertical sectional view taken at right angles to the FIG. 4 view.

Still with reference to FIGS. 4 and 5, the grid portion of the panel defined generally between the sides 10 and 12 of the rectangular frame can be seen to further include an inner or lower grid portion, which is also integrally molded to the frame and to the outer portion as well, which inner portion includes longitudinally extending ribs or extensions of the ribs 14, 14 as well as the extension of the inner section cross ribs 16, 16, which extensions or inner grid portion ribs correspond in thickness and in location to the intersecting ribs 14 and 16. The inner grid portion defined by these intersecting rib extensions and cross rib extensions also includes longitudinally and laterally extending mutually perpendicular partitions, 18 and 20 respectively, which partitions are integrally molded to the said rib extensions. These partitions define relatively smaller rectangular openings and it is a feature of the present invention that these smaller openings are generally square, and have a dimension corresponding generally to the thickness of the ribs and rib extensions mentioned previously. The presently preferred size of this dimension for present day barrels is three thirty-seconds of an inch, but slightly larger or smaller openings might be provided for to accommodate larger or smaller articles in the electroplating process. A dimension for this parameter between one-sixteenth and one-eighth of an inch yields desirable results, best results being obtained with a value of three thirty-seconds of an inch.

Referring once again to the view of FIG. 1, and as mentioned previously, the rectangular frame shown has a length L1 and a width W1. These dimensions can be varied simply by cutting the panel along predetermined lines of weakening or score lines such as illustrated for example at 22, 24, and 26 and 28. Each of these lines of weakening is defined adjacent an integrally molded brace extending either longitudinally or laterally in direction and oriented parallel one or the other of the marginal sides 10 and 12 of the rectangular frame. Each of these brace portions also has a cross sectional configuration similar to that of the frame side to which it corresponds, and the line of weakening may either comprise a notch such as shown at 26 in FIG. 4 or may be arranged between a rib 14 and the brace member itself such as shown at 10*a* in FIG. 5, and as illustrated generally by the notch 22.

By way of summary then, the one-size panel described herein is so designed that it can be used to assemble polygon shape electroplating barrels of various size whether of different diameters from one another or of differing axial lengths, the panel being such that it can be molded in one-piece from a chemically inert plastic material such as polypropylene to which a substantial portion by weight, preferably 20%, of chopped glass fiber material has been added. The outer portion of the grid defining structure includes relatively wide longitudinally extending ribs which act as paddles to agitate the electrolyte during rotation of the barrel, as well as intersection cross ribs which are of equal width and serve to strengthen the longitudinally extending paddle-like ribs. These ribs also extend inwardly or radially of the barrel and define breaker bars 14*a*, 14*a* which serve to break up the load of articles being electroplated within the barrel. The inner portion of the grid defining structure for each panel also includes longitudinally extending ribs and intersecting ribs corresponding in location and size with those defining the outer portion with the relatively large rectangular openings.

It is a further feature of the present invention that such inner grid portion further includes longitudinally and laterally extending partitions which define relatively small square openings such that the articles being plated are not entangled in the barrel as the barrel rotates but are instead caused to tumble during the plating operation. Braces are provided parallel the edges 10 and 12 of the panel and these braces serve to define a rectangular frame for the panel when it is cut along one or the other of the lines of weakening indicated generally in FIG. 1.

As shown in FIG. 1 the panel is symmetrical left to right with a generally centrally arranged brace being provided primarily to improve the distribution of the liquid plastic material in the mold during the forming of the panel itself. The braces also serve this function but are intended primarily to define the rectangular frame for one of the various rectangular sizes permitted as a result of the present design. That is, a length L2 can be provided for in addition to the length L1 by severing the panel along the line of weakening 28. A panel L3 in length can be provided by severing the panel along the lines of weakening 26 and 28 shown in FIG. 1. The panel width can be varied from the dimension W1 depicted in FIG. 1 by severing the panel along the line of weakening 22 so as to provide a panel of width W2. Finally, width W3 is provided for by severing the panel along the line of weakening 24.

Figure 6:
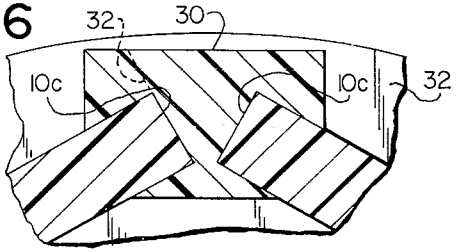
FIG. 6 is a fragmentary view illustrating one of the end plates provided in a typical polygon shaped electroplating barrel, together with one of the support members to which the panels of the present invention are fitted so as to provide a generally polygon shape electroplating barrel.

FIG. 6 shows two such panels joined along their marginal or longer side edges by means of a support member 30 of the type normally used in fabricating polygon shaped barrels generally. One of the two end plates is also shown and is indicated generally at 32 at FIG. 6. The longitudinally extending side edges of two adjacent panels are also shown and are indicated generally at 10*c*, 10*c*. Each of these side edges of each of these panels is being received in a corresponding formed slot provided for this purpose in the support member 30. In accordance with conventional practice one of these panels may be removable, to provide access to the interior of the barrel, as for example by cutting away the support member 30 generally along the lines indicated generally at 32 in FIG. 6. When such a removable panel is provided for, two such support members 30 must be so cut, and a panel received therein must be releasably retained in the openings so defined by conventional means as for example by spring clips or the like.

I claim:

1. A panel for use in constructing polygon shaped barrels of differing sizes, said panel comprising:

a. an integrally molded rectangular frame portion defining the periphery of said panel and having marginally extending sides of generally square cross section, b. an outer grid portion within said frame portion and integrally molded thereto, said outer portion including longitudinally extending ribs and intersecting cross ribs defining relatively large rectangular openings therebetween, c. an inner grid portion within said frame portion and integrally molded to said outer portion and to said frame, said inner portion including longitudinally extending ribs and intersecting cross ribs corresponding in thickness and in location to said ribs defining said outer grid portion, and each rectangular opening defined between said inner grid openings being further divided by longitudinally and laterally extending partitions defining relatively small rectangular openings, said partitions integrally molded to said ribs defining said large openings, d. at least one integrally molded brace oriented parallel one of said marginal sides and spaced therefrom, said brace having a cross sectional configuration similar said frame side and a predetermined line defined adjacent said brace and in the space between said brace and said parallel side to provide a slightly smaller size panel when said panel is severed along said line.

2. The panel defined in claim 1 wherein said rectangular frame brace extends longitudinally of said frame and parallel the longer sides of the rectangle.

3. The panel defined in claim 1 wherein said rectangular frame brace extends perpendicular to the longitudinal direction of said frame and parallel the shorter sides of the rectangle.

4. The panel defined in claim 1 wherein said integrally molded panel is fabricated from a chemically inert plastic material and includes a substantial portion of chopped glass fibers, preferably 10 to 30% by weight.

5. The panel defined in claim 1 further characterized by inwardly projecting breaker bars integrally molded to said longitudinally extending ribs in said inner grid portion, said breaker bars having a height at least approximately equal to the thickness of said ribs on which said bars are defined.

6. The panel defined in claim 2 further characterized by a frame brace perpendicular said longitudinal brace, and a predetermined line adjacent said perpendicular brace between it and one of said shorter dies of said frame.

7. The panel defined in claim 6 further characterized by inwardly projecting breaker bars integrally molded to said longitudinally extending ribs in said inner grid portion, said breaker bars having a height at least approximately equal to the thickness of said ribs on which said bars are defined.

8. The panel defined in claim 7 wherein said smaller rectangular openings in said inner grid portion have a square configuration the length of the side of such square openings being at least approximately equal to the thickness of said longitudinally extending ribs.

9. The panel defined in claim 8 wherein said square openings have a length in the range between one-sixteenth and one-eighth of an inch.

* * * * *